US006715947B1

(12) United States Patent
Cornelius et al.

(10) Patent No.: US 6,715,947 B1
(45) Date of Patent: Apr. 6, 2004

(54) LOW ROTATIONAL INERTIA SHUTTLE SYSTEM WITH A FLATTENED SINUSOIDAL CARRIAGE VELOCITY

(75) Inventors: Craig Jack Cornelius, Woodinville, WA (US); John Wayne Whiting, Kent, WA (US); Charles Gordon Whitaker, Mercer Island, WA (US)

(73) Assignee: Tally Printer Corporation, Kent, WA (US)

( * ) Notice: Subject to any disclaimer, the term of this patent is extended or adjusted under 35 U.S.C. 154(b) by 68 days.

(21) Appl. No.: 09/877,545

(22) Filed: Jun. 8, 2001

(51) Int. Cl.[7] ..... B41J 23/14; B41J 23/18; B41J 23/02

(52) U.S. Cl. ..... 400/322; 400/320

(58) Field of Search ..... 400/320, 283, 400/124.01, 323, 322; 74/25–62, 603, 604; 101/93.04; 248/564; 235/454–473; 188/378

(56) References Cited

U.S. PATENT DOCUMENTS

| | | | |
|---|---|---|---|
| 3,670,861 A | 6/1972 | Zenner et al. | |
| 3,782,278 A | 1/1974 | Barnett et al. | |
| 3,804,626 A | 4/1974 | Harvey | |

(List continued on next page.)

FOREIGN PATENT DOCUMENTS

| | | | | |
|---|---|---|---|---|
| JP | 57093166 A | * | 6/1982 | ..... B41J/3/10 |
| JP | 58089378 A | * | 5/1983 | ..... B41J/3/10 |
| JP | 58112757 A | * | 7/1983 | ..... B41J/3/10 |
| JP | 63122562 A | * | 5/1988 | ..... B41J/3/10 |
| JP | 02120050 A | * | 5/1990 | ..... B41J/2/245 |
| JP | 4-301461 | | 10/1992 | |

*Primary Examiner*—Daniel J. Colilla
(74) *Attorney, Agent, or Firm*—Christensen O'Connor Johnson Kindness PLLC

(57) ABSTRACT

A low rotational inertia shuttle system (24) for a dot matrix line printer (20) is disclosed. The low rotational inertia shuttle system (24) includes an elongate support structure (26), a carriage (22) and a counterbalance (62). The carriage and the counterbalance are reciprocally mounted on the support structure. The low rotational inertia shuttle system also includes a reciprocating assembly (60) disposed on the support structure for reciprocating the carriage and the counterbalance. The reciprocating assembly has an inertia that is purposely minimized with respect to the mass of the carriage and the counterbalance, such that the printer operates at a substantially constant level of kinetic energy to produce a substantially linear velocity profile for the carriage. The low rotational inertia shuttle system further includes a rotational mechanism (64) that is coupled to the reciprocating assembly for controlling energy applied to the reciprocating assembly in a way that maximizes the linearity of the carriage velocity profile.

29 Claims, 5 Drawing Sheets

U.S. PATENT DOCUMENTS 3,810,189 A 5/1974 Casperson et al.
3,874,492 A 4/1975 Hurst
3,941,051 A * 3/1976 Barrus et al. ..... 101/93.04
3,941,230 A 3/1976 Bellino et al.
3,942,619 A 3/1976 Nordstrom et al.
4,159,882 A 7/1979 Sanders, Jr. et al.
4,239,403 A 12/1980 Matula et al.
4,248,148 A 2/1981 Mahoney et al.
4,250,808 A 2/1981 Katsura et al.
4,289,069 A 9/1981 Melissa et al.
4,336,751 A 6/1982 Melissa et al.
4,340,848 A 7/1982 Hanagata et al.
4,351,235 A 9/1982 Bringhurst
4,359,289 A 11/1982 Barrus et al.
4,364,024 A 12/1982 Paetsch
4,387,642 A 6/1983 Bringhurst et al.
4,400,104 A 8/1983 McCray et al.
4,444,521 A 4/1984 Rickard et al.
4,462,702 A 7/1984 Fritz et al.
4,480,541 A 11/1984 Grummett
4,513,661 A 4/1985 Melissa et al.
4,543,002 A 9/1985 Bittner et al.
4,565,127 A 1/1986 Pichler et al.
4,588,316 A 5/1986 Everett, Jr.
4,601,241 A 7/1986 Fujiwara
4,625,638 A 12/1986 Fritz et al.
4,632,584 A 12/1986 Becchi et al.
4,688,956 A 8/1987 Miyake
4,693,618 A 9/1987 Hanagata
4,749,294 A * 6/1988 Barrus et al. ..... 400/322
4,869,610 A 9/1989 Nishizawa et al.
4,897,589 A 1/1990 Fujiwara et al.
5,059,047 A 10/1991 Nakamura et al.
5,129,746 A * 7/1992 Epstein ..... 400/323
5,201,267 A * 4/1993 Porucznik et al. ..... 100/48
5,366,303 A 11/1994 Barrus et al.
5,666,880 A 9/1997 Barrus

* cited by examiner

LOW ROTATIONAL INERTIA SHUTTLE SYSTEM WITH A FLATTENED SINUSOIDAL CARRIAGE VELOCITY

FIELD OF THE INVENTION

The present invention relates generally to carriage shuttling systems and, more particularly, to shuttling systems for shuttling the print head of a dot matrix line printer.

BACKGROUND OF THE INVENTION

While, as will be better understood from the following description, the present invention was developed to shuttle the print head of a dot matrix line printer and, thus, is expected to find its primary use in such printers, it is to be understood that the invention can be used to shuttle the carriages of other mechanisms requiring or desiring nearly constant velocity shuttle motion through most of the stroke.

Various types of dot matrix line printers have been proposed and are in use. In general, dot matrix line printers include a print head comprising a plurality of dot printing mechanisms, each including a dot-forming element. The dot forming elements are located along a line that lies orthogonal to the direction of paper movement through the printer. Since paper movement is normally vertical, the dot forming elements usually lie along a horizontal line. Located on the side of the paper remote from the dot forming elements is a platen and located between the dot forming elements and the paper is a ribbon. During printing, the dot forming elements are shuttled back and forth. As the dot forming elements are shuttled, they are actuated to create dots along the print line defined by the dot forming elements. The paper is incremented forwardly after each dot row is printed. A series of dot rows creates a row of characters or a graphical image.

The dot forming elements of contemporary dot matrix line printers are small anvils located on one end of an electromagnetically actuated hammer. The hammers are normally held in a retracted position by magnetic force. Release is created by the application of a pulse to an electromagnetic coil that produces a magnetic field that counteracts the retracting field. The dot forming element, hammer, retracting magnet, release coil, and related elements form a dot forming mechanism. The dot forming mechanisms may be grouped in sets of two or more and mounted on a carriage such that the dot forming elements are spaced apart and offset in a predetermined manner. See, for example, U.S. Pat. No. 4,351,235, titled Dot Printing Mechanism for Dot Matrix Line Printers.

Shuttling of the dot printing elements back and forth is accomplished by translating the carriage. In one type of line printer, the carriage is reciprocally mounted on a frame by a suitable support mechanism, such as a linear bearing. The carriage shuttle motion is a consequence of a crank driving either a connecting rod or a Scotch yoke. The axis of rotation of the crank is coaxial with the axis of rotation of a heavy flywheel. The heavy flywheel supplies and absorbs the energy required to accelerate and decelerate the carriage with only negligible changes to its rotational speed. While the near-constant angular velocities that result from heavy flywheel carriage shuttle systems have some advantages, they also have a number of disadvantages.

A carriage that shuttles back and forth must do so with a velocity that changes with time because the carriage must stop and reverse direction at the end of each shuttle stroke. In a heavy flywheel shuttle system, the energy stored in the rotational motion of the flywheel is substantially greater than the energy stored in the translational motion of the carriage where rotational kinetic energy is equal to ½ times the moment of inertia times the angular velocity, in radians, squared and where the translational kinetic energy is equal to ½ times the mass times the linear velocity squared. As a result, the change in the angular velocity of the flywheel due to the deceleration of the carriage at the end of the print stroke is negligible. The nearly constant angular velocity of the flywheel causes the shuttle mechanism to accelerate from zero velocity at its end of a shuttle stroke to peak velocity near the middle of the shuttle stroke. The end result is a carriage velocity profile that is sinusoidal for a Scotch yoke mechanism and nearly sinusoidal for a crank/connecting rod/slider mechanism.

A printer whose carriage has a sinusoidal velocity profile is significantly slower than a printer having a more constant velocity profile. This result occurs because the average velocity of a sinusoidal velocity profile carriage is 64% of the peak velocity. The peak shuttle velocity for a printer is limited by the maximum firing rate of the dot making mechanism, while the overall printing speed is a function of the average shuttle velocity. The more constant the carriage velocity and, thus, the flatter the velocity profile during the printing portion of a sweep, the greater the printer speed. Therefore, it is desirable that the carriage of a dot matrix line printer have a substantially constant velocity profile during the print portion of a shuttle stroke.

In the past, various types of dot matrix line print carriage shuttle systems for achieving a more constant shuttle velocity profile have been proposed. One such proposal is to use a cam/cam follower carriage shuttle system to convert a constant angular input velocity to a flattened near-constant output velocity. However, cam/cam follower carriage shuttle systems are undesirable in a dot matrix line printer because they are subject to a high degree of mechanical wear. More specifically, dot matrix line printers, particularly high speed dot matrix line printers, require precision positioning of the printer head at the time the dot-forming elements are actuated by their related actuating mechanisms. Mechanical wear reduces the precision with which the print head can be positioned. As print head positioning precision drops, dot misregistration increases. As a result, printed characters and images are distorted and/or blurred. Distorted and/or blurred images are, of course, unacceptable in environments where high quality printing is required or desired.

Another prior proposal directed to providing a dot matrix line printer carriage having a more constant shuttle velocity profile is to mount the carriage on a continuous band driven by a motor. A major problem associated with a band-driven system is that the motor must stop at the end of each stroke and reverse the direction of the carriage. Reversing the direction of a carriage requires a large energy input to the motor because the motor must control the deceleration of the carriage and then, immediately thereafter, the acceleration of the carriage. Another problem associated with belt-driven systems derives from the fact that the stroke of the shuttled carriage is not mechanically restrained and, therefore, the extremes of travel are not defined. Because the extremes of travel are not defined, band-driven systems require mechanical stops.

Linear motors have also been employed in the past to produce near-constant shuttle velocities. But linear motors adequate to drive the dot matrix line printer carriage are undesirably large and expensive.

Thus, there exists a need for a relatively simple and energy efficient dot matrix line printer carriage shuttle system that has a substantially constant velocity profile across the print portion of the shuttle stroke. The present invention is directed to fulfilling this need.

SUMMARY OF THE INVENTION

In accordance with the present invention, a low rotational inertia shuttle system that is ideally useful in shuttling the print head of a dot matrix line printer is provided. The low rotational inertia shuttle system includes a mechanism to convert angular input motion to linear output motion. Such a mechanism could consist of a Scotch yoke, a crank-connecting rod-slider or a cam and cam follower. The specific requirement is that for a constant angular input velocity, the output velocity is sinusoidal or near-sinusoidal. A duplicate mechanism may be present to drive a counter-balance. The inertia of the rotating components is purposely minimized with respect to the mass of the carriage and the counterbalance. The low rotational inertia shuttle system further includes a source of mechanical power in the form of a rotary motor that causes the input to the mechanism to rotate. The rotary motor is controlled in such a fashion that it only supplies energy to overcome the frictional losses of the shuttle mechanism. The energy to accelerate and decelerate the carriage subtracts from and adds to the rotational energy of the rotating elements of the system. Because the rotational energy of the rotating elements (reciprocating mechanism) is on the same order as the energy in the reciprocating carriage mass and counterbalance, removal and addition to the rotational energy of the rotating elements results in a significant slowing of the angular input speed during mid-stroke and a significant speeding up of the angular input speed at the ends of the stroke. As a result of the changes in input angular speed, the output linear speed is increased at the ends-of-stroke and decreased during mid-stroke when compared to the output speed of a printer having a large rotational mass, such as a flywheel. This flattens the sinusoidal output velocity and makes the speed more constant over the dot forming portion of the shuttle stroke. Thus, by purposely minimizing the rotational inertia of the system, the output velocity is made more constant.

In accordance with further aspects of this invention, the reciprocating mechanism of the low rotational inertia shuttle system is a linkage that includes dual throw cranks and horizontally opposed connecting arms pivotally disposed between the carriage and counterbalance. This linkage converts a constant angular input velocity to a near-sinusoid linear output velocity.

In accordance with yet other aspects of this invention, the low rotational inertia shuttle system includes a stepper motor connected to the dual throw cranks. The stepper motor is controlled by a programmed control system. The program causes the stepper motor to track the natural tendency of the input angular velocity to speed up and slow down so as to maximize the linearity of the carriage velocity profile in the range where printing occurs.

A low rotational inertia shuttle system formed in accordance with the present invention has several advantages over shuttle systems used in the past in dot matrix line printers. The purposeful minimization of the inertia of the rotational elements with respect to the mass of the carriage and counterbalance conserves the system's kinetic energy and produces a carriage velocity profile that is substantially linear throughout the print range of the dot matrix line printer. While the low rotational inertia shuttle system can be driven by a DC motor, the use of a stepper motor to selectively add or remove energy maximizes the linearity of the carriage velocity profile. Thus, a printer incorporating the present invention requires less energy to run and, therefore, is cheaper to build and to operate than those currently available. Such a printer can be operated at higher speeds without a loss of print accuracy. As a result, printer throughput is enhanced.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
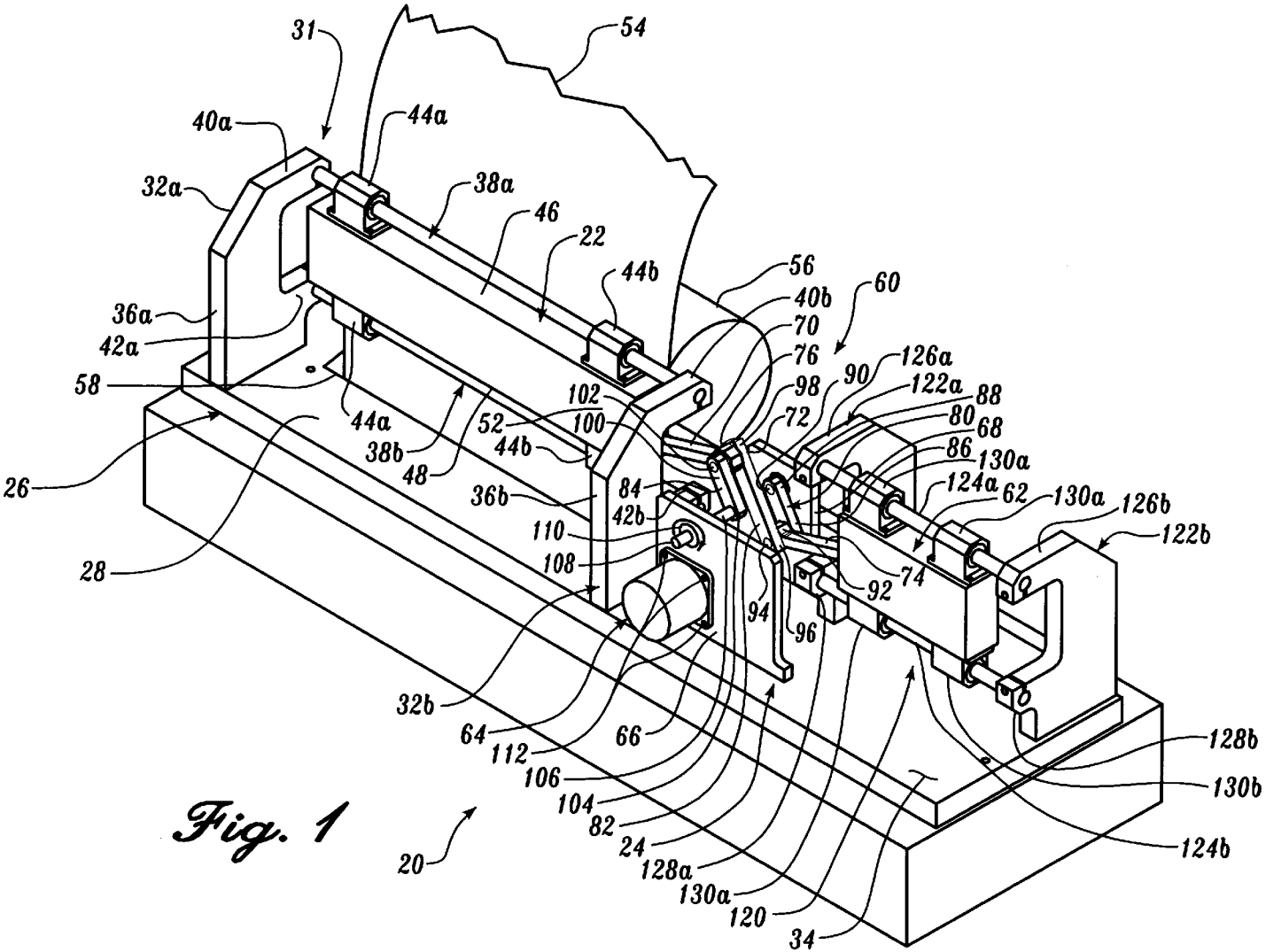
FIG. 1 is a perspective view of a dot matrix line printer incorporating a low rotational inertia carriage shuttle system formed in accordance with the present invention.
Figure 2:
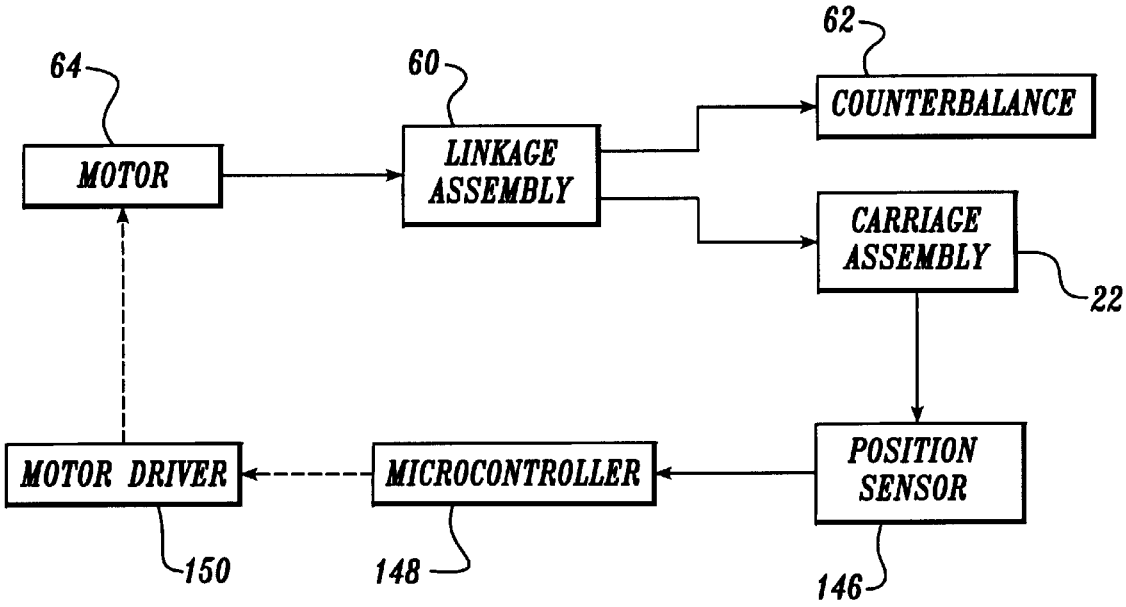
FIG. 2 is a block diagram showing the major elements of the dot matrix line printer shown in FIG. 1.

FIG. 1 illustrates a preferred embodiment of a dot matrix line printer 20 including a low rotational inertia shuttle system 24 constructed in accordance with the present invention. The dot matrix line printer 20 includes a carriage 22, the low rotational inertia shuttle system 24, a platen 56, and other necessary dot matrix line printer elements, such as a print ribbon, not shown so that the invention can be more easily seen, but well known to those familiar with dot matrix line printers. The carriage 22 and the low rotational inertia shuttle system 24 are mounted on a suitable support structure that, for ease of illustration, is depicted as an elongate base plate 26. The carriage 22 is reciprocally mounted on one end 28 of the base plate 26 by a carriage support assembly 31.

The carriage support assembly 31 includes first and second carriage support 32*a* and 32*b* and first and second carriage guide rods 38*a* and 38*b*. The carriage support members 32*a* and 32*b* have a substantially C-shaped configuration and are rigidly mounted in spaced apart relationship, parallel to one another, and orthogonal to the longitudinal axis of the elongate base plate 26. If mounted on a base plate as shown in FIG. 1, the carriage support members may be attached to the base plate by any type of well known fasteners (not shown), such as bolts, extending vertically through the base plate 26 and into the ends of base stems 36*a* and 36*b* that extend downwardly from the spines of the carriage support members 32*a* and 32*b*, respectively. Alternatively, the base stems 36*a* and 36*b* of the carriage support members 32*a* and 32*b* may be welded to the base plate 26 or integrally formed therewith as part of a single casting.

The carriage support members 32*a* and 32*b* are positioned on the upper surface 34 of the base plate 26, such that the upper and lower arms 40*a* and 42*a* of the first carriage support member 32*a* and the upper and lower arms 40*b* and 42*b* of the second carriage support member 32*b* extend inboard from an outer edge of the base plate 26, toward the platen 56, which lies parallel to the carriage 22. The carriage support members 32*a* and 32*b* are spaced from one another by an amount adequate to receive the carriage 22 therebetween.

The carriage 22 is reciprocally mounted on the first and second carriage guide rods 38*a* and 38*b* which extend between the carriage support members 32*a* and 32*b*. More specifically, the first carriage guide rod 38*a* is rigidly supported by and extends between the upper arms 40*a* and 40*b* of the first and second carriage support members 32*a* and 32*b*. The second carriage guide rod 38*b* is rigidly supported by and extends between the lower arms 42*a* and 42*b* of the carriage support members 32*a* and 32*b*. The first and second carriage guide rods 38*a* and 38*b* lie parallel to each other and in the same vertical plane. The first and second carriage guide rods 38*a* and 38*b* are spaced apart by an amount adequate to receive the carriage 22 therebetween. Thus, the carriage guide rods 38*a* and 38*b* and the carriage 22 are vertically aligned. Further, the carriage guide rods 38*a* and 38*b* and the carriage 22 lie parallel to the longitudinal axis of the elongate base plate 26.

The carriage 22 is elongate and supports a plurality of dot printing mechanisms well known to those skilled in the dot matrix line printer art. In general, each dot printing mechanism includes a hammer and a hammer actuating magnetic structure. The hammer is resilient, i.e., is formed of a resilient piece of metal or includes a resilient piece of metal. Mounted in the end of the hammer is a dot producing anvil. In many dot matrix line printers, the hammers are held in a retracted, cocked state by a permanent magnet and released by applying a pulse to an electromagnet. The electromagnet creates a magnetic field that counteracts the magnetic field produced by the permanent magnet, releasing the energy stored in the hammer. A plurality of dot printing mechanisms can be combined into a module and the modules mounted on the carriage. See U.S. Pat. No. 4,351,235 titled "Dot Printing Mechanisms for Dot Matrix Line Printers", by Edward D. Bringhurst and U.S. Pat. No. 4,584,937 titled "Long Release Coil Hammer Actuating Mechanism" by Edward D. Bringhurst, the subject matter of which is incorporated herein by reference, for a more detailed description of exemplary dot printing mechanisms for dot matrix line printers.

The position of the carriage 22 is sensed by a position sensor, not shown but well known in the dot matrix line printer art. The position sensor produces a position signal relative to a predetermined position, such as the end of a print stroke that is used to perform position sensitive tasks, such as timing the actuation of the dot printing mechanisms and assisting in controlling the low rotational inertia shuttle system 24, in the manner described below.

The platen 56 is mounted by brackets (not shown) and fasteners (not shown), such that, as noted above, the platen 56 lies parallel to the carriage 22. The platen 56 provides a solid striking surface for the dot printing mechanisms. Print paper 54 passes between the dot printing mechanisms mounted on the carriage 22 and the platen 56. Located between the dot printing mechanisms and the paper, but not shown in FIG. 1 in order for the invention to be more readily observed, is a print ribbon. The paper 54 passes through an elongate paper slot 58 located in the upper surface 34 of the base plate 26. The paper 54 is stepped upwardly through the paper slot 58 and between the print ribbon and the platen 56 at a controlled rate by a drive mechanism well known in the art, such as a pair of tractor drives (not shown) operated by a stepper motor (also not shown). The drive mechanism incrementally steps the paper 54 upwardly after each of the hereinafter described strokes of the carriage 22.

The carriage 22 is supported by a plurality of linear bearings mounted on the first and second carriage guide rods 38*a* and 38*b*. The mounting is such that the carriage 22 is free to move in a direction parallel to the elongate direction of the carriage guide rods 38*a* and 38*b*. More specifically, a first set of linear bearings 44*a* are rigidly attached to the upper and lower surfaces 46 and 48 of the carriage 22, near one end thereof. A second set of linear bearings 44*b* are attached to the upper and lower surfaces 46 and 48 of the carriage 22, near the other end 52. The first and second sets of linear bearings 44*a* and 44*b* permit the carriage 22 to freely slide back and forth between the carriage support members 32*a* and 32*b*.

The low rotational inertia shuttle system 24 includes a rotational motion-linear linkage assembly 60, a counterbalance 62, and a drive motor 64. The rotational motion-linear linkage assembly 60 ("linkage assembly 60") is located between the carriage 22 and the counterbalance 62. The linkage assembly 60 is mounted on opposing first and second plates 66 and 68. The first and second plates 66 and 68 are, in turn, mounted on the base plate 26, adjacent to the second carriage support member 32*b*. The first and second plates 66 and 68 are substantially square in configuration and are mounted on the upper surface 34 of the base plate 26, so as to lie parallel to the longitudinal axis of the base plate 26 on either side of the sliding axis of the carriage 22. The plates 66 and 68 lie parallel to each other and are spaced apart by a distance adequate to receive the linkage assembly 60 therebetween.

The linkage assembly 60 includes dual throw cranks and horizontally opposed connecting rods. In this regard, while a linkage assembly 60 formed of dual throw cranks and horizontally opposed connecting rods is presently preferred, it is to be understood that other types of linkage assemblies can be used, such as a Scotch yoke mechanism or sinusoidal cam-slider assembly, as is described in greater detail below.

The linkage assembly 60 includes a first connecting member or rod 70, a crank arm assembly 72, and a second connecting member or rod 74. The connecting rods 70 and 74 are elongate. Preferably, the connecting rods 70 and 74 are manufactured from a high strength, lightweight material, such as aluminum. One end of both the connecting rods 70 and 74 are pivotally connected to the crank arm assembly 72, at opposite ends thereof. The other end (not shown) of the first connecting rod 70 is pinned to the second end 52 of the carriage 22. The other end (also not shown) of the second connecting rod 74 is pinned to one end of the counterbalance 62. Thus, the crank arm assembly 72 is disposed between the carriage 22 and the counterbalance 62 and connected thereto by the connecting rods 70 and 74.

Still referring to FIG. 1, the crank arm assembly 72 includes first, second, and third rotational members or crank arms 80, 82, and 84. The crank arms 80, 82, and 84 are elongate members, preferably manufactured from a lightweight, high strength material, such as aluminum. The length of the first and third crank arms 80 and 84 is the same. The second crank arm 82 is twice as long as the first and third crank arms 80 and 84. One end 88 of the first crank arm 80 is rotatably mounted to the second plate 68 by a first pin 90. More specifically, the first pin 90 is affixed to and extends laterally outwardly from the end 88. The first pin 90 extends at least partially into the second plate 68, where it is seated in a rotary bearing (not shown). The other end 86 of the first crank arm 80 and one end 96 of the second crank arm 82 are pivotally connected to the outer end 92 of the second connecting rod 74 by a second pin 94. More specifically, the second pin 94 is rotatably mounted in the outer end 92 of the second connecting rod 74 so as to extend laterally outwardly therefrom on both sides. The other end 86 of the first crank arm 80 is affixed to one side of the pin 94 and the other end 96 of the second crank arm 82 is affixed to the other side of the pin 94. The affixation is such that the longitudinal axes of the first and second crank arms 80 and 82 lie parallel to one another. Thus, the outer end 92 of the second connecting rod 74 is hingedly pinned to an end 86 and 96 of each of the first and second crank arms 80 and 82.

As noted above, the first connecting rod 70 is also pinned to the crank assembly 72. More specifically, the outer end 76 of the first connecting rod 70 is hingedly connected to the other end 98 of the second crank arm 82 and one end 100 of the third crank arm 84 by a third pin 102. The third pin 102 is rotatably mounted in and extends laterally through the outer end 76 of the first connecting rod 70. The other end 98 of the second crank arm 82 is affixed to one side of the third pin 102 and the one end 100 of the third crank arm 84 is connected to the other side of the third pin 102. The affixation is such that the longitudinal axes of the second and third crank arms 82 and 84 lie parallel to one another.

The other end 104 of the third crank arm 84 is affixed to one end 106 of a drive axle 108, such that the third crank arm 84 rotates with the drive axle 108. The other end of the drive axle 108 is journaled to the upper end of the first plate 66 by a rotary bearing 110. The longitudinal axis of the drive axle 108 is co-axial with the longitudinal axis of the first pin 90. The drive axle 108 is operatively connected to a well-known energy transfer assembly (not shown), such as a plurality of meshed gears, disposed on the inboard-facing surface of the first plate 66. The drive motor 64 is rigidly fastened to the outboard-facing surface of the first plate 66 by a plurality of well known fasteners 112, such as bolts. The axle of the drive motor 64 passes through the first plate 66 and is operatively connected to the energy transfer assembly in a conventional manner (not shown). As will be better understood from the following description, the drive motor 64 supplies energy to the crank arm assembly 72 that is used to control the reciprocation of the carriage 22 and the counterbalance 62.

The counterbalance 62 is reciprocally mounted on a counterbalance support assembly 120 located on the other end 30 of the base plate 26. The counterbalance support assembly 120 includes upwardly projecting first and second support members 122*a* and 122*b* and first and second counterbalance guide rods 124*a* and 124*b*. The support members 122*a* and 122*b* are substantially C-shaped in configuration and are rigidly fastened to the upper surface 34 of the base plate 26. The support members 122*a* and 122*b* are attached to the base plate 26 by well known fasteners (not shown) or welded thereto. Alternatively, the support members 122*a* and 122*b* may be integrally formed with the base plate 26 as part of a unitary casting. The support members 122*a* and 122*b* are located in spaced, parallel relationship, such that the upper and lower arms 126*a* and 128*a* of the first support member 122*a* and the upper and lower arms 126*b* and 128*b* of the second support member 122*b* extend inboard from an outer edge of the base plate 26. This outer edge lies parallel to and on the opposite side of the base plate 26 from the outer edge associated with the first and second support members 32*a* and 32*b* of the carriage support assembly 31. Thus, as located on the upper surface 34 of the base plate 26, the upper and lower arms of the carriage support assembly 31 and the counterbalance support assembly 120 extend inboard from opposing edges of the base plate 26 and are located on opposite ends 28 and 30 of the base plate 26.

The support members 122*a* and 122*b* are spaced by a distance adequate to receive the counterbalance 62 therebetween. More specifically, the first and second counterbalance guide rods 124*a* and 124*b* extend between the upper and lower arms 126*a*, 126*b* and 128*a*, 128*b*, respectively. The counterbalance 62 is reciprocably mounted on first and second counterbalance guide rods 124*a* and 124*b* by first and second sets of linear bearings 130*a* and 130*b* in a manner similar to that described above for the carriage 22. The counterbalance 62 is sized to have a mass substantially equal to the mass of the carriage assembly 22. As a result, shuttling the counterbalance 62 at the same time the carriage 22 is shuttled causes the system to absorb the shuttling motion of the carriage 22, thereby substantially reducing the vibration and shaking that would occur when the carriage 22 is shuttled absent the counterbalance 62.

Operation of the printer 20 of the present invention may be best understood by referring to FIGS. 1–4. As will be readily understood from the foregoing description and viewing FIG. 1, the carriage 22 and the counterbalance 62 are coupled to reciprocate in opposed motion relative to each other on their respective support assemblies by the linkage assembly 60. The system is shown schematically in FIG. 2. Power supplied by the drive motor 64 causes the linkage assembly 60 to linearly translate both the carriage 22 and the counterbalance 62. As the carriage 22 is shuttled, a position sensor 146, located on the carriage 22, senses the position of the carriage 22 and sends a position signal to the microcontroller 148. The position signal may occur at the end of a stroke, in the middle of a stroke, or at any point in between. Alternatively, multiple position signals can be produced as the carriage translates back and forth. The microcontroller 148 receives signals from the position sensor 146 and converts the received signal into an output control signal that is used to control position sensitive tasks, such as actuating the hammerbank at appropriate intervals by means well known in the art. In some versions of the invention, described below, the microcontroller 148 provides signals to a motor driver 150 that actively controls the drive motor 64 in a manner that optimizes the constancy of the velocity profile of the carriage 22.

Referring back to FIG. 1, reciprocation of the carriage 22 and the counterbalance 62 will now be described in greater detail. When power is supplied to the motor 64 by an external power source (not shown), the motor 64 applies torque to the drive axle 108, causing the third crank arm 84 to rotate about the drive axle 108. As described above, all of the crank arms 80, 82, and 84 are pinned to each other. As a result, when one of the three crank arms rotate, the other two also rotate. As the third crank arm 84 rotates with the drive axle 108, the first crank arm 80 rotates the first pin 90 in its journal in the second plate 68. As a result, the second crank arm 82 rotates about a point that lies on the axis of the drive axle 108 and the first pin 90. The crank arms 80, 82, and 84 rotate about their common axis of rotation at the same rate and in the same direction.

As described above, the first and second connecting rods 70 and 74 are pinned between the ends of the crank arms 80, 82, and 84, such that as the crank arms 80, 82, and 84 rotate, they reciprocate the first and second connecting rods 70 and 74 toward and away from the first and second ends 28 and 30 of the base plate 26. As a result, the connecting rods 70 and 74 and the crank arms 80, 82, and 84 reciprocate the carriage 22 and the counterbalance 62 in opposite directions. That is, as the carriage 22 moves toward the second end 30 of the base plate 26, the counterbalance 62 simultaneously moves toward the first end 28 of the base plate 26. As a result, the carriage 22 and the counterbalance 62 move toward one another. In the return stroke, the connecting rods 70 and 74 and the crank arms 80, 82 and 84 drive the carriage 22 and the counterbalance 62 longitudinally away from each other. As noted above, the mass of the counterbalance 62 is sized to offset the mass of the carriage 22. As a result, the opposed motion of the counterbalance relative to the carriage 22 absorbs the vibration and shaking that would be associated with reciprocating the carriage 22 in the absence of the counterbalance 62.

The amount that the carriage 22 and the counterbalance 62 reciprocate is limited to a predefined distance (E) determined by the length (e) of the first and third crank arms 80 and 84. It is important to note that the shuttling system of the invention has low rotational inertia. That is, the shuttling system does not include a separate flywheel and the drive motor 64 is required to change speed during a shuttle stroke.

Figure 3:
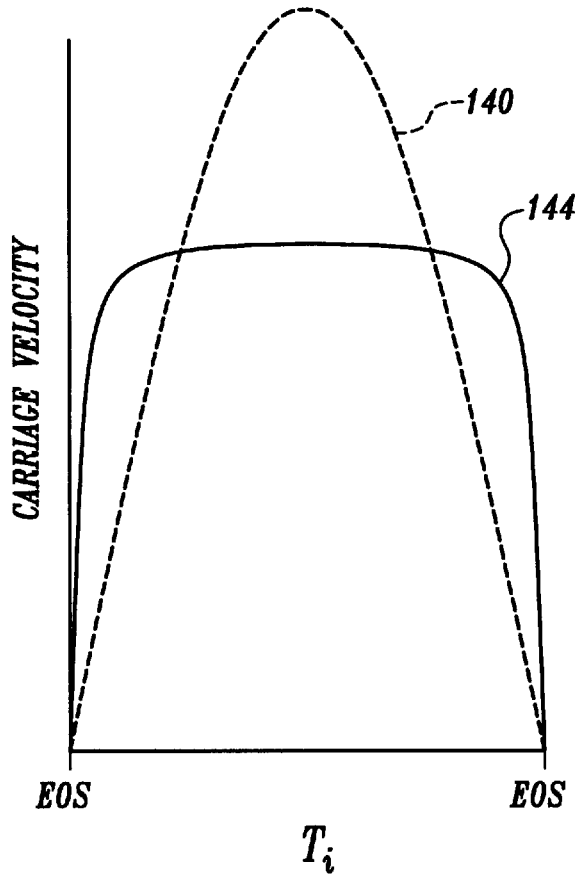
FIG. 3 is a velocity profile diagram comparing the velocity profile of a carriage moved by a low rotational inertia shuttle system formed in accordance with the invention with a large flywheel shuttle system of the type used in currently available printers.

Line printers that utilize a heavy flywheel to absorb speed fluctuations have a carriage velocity profile that is substantially sinusoidal, as shown by the first curve 140 in FIG. 3. A sinusoidal carriage velocity profile is undesirable in printers because the resulting average shuttle speed is only 64% of the peak velocity. As a result, printer throughput is less than the printer is potentially capable of producing. A more desirable shuttle velocity profile is one that is substantially more constant because it has a higher average speed, enhancing printer throughput. A printer 20 including a low rotational inertia shuttle system 24 formed in accordance with the invention has a near constant velocity profile because the rotational inertia of the system is purposefully minimized with respect to the translational inertia of the system, and because the motor 64 allows for a cyclically changing rotary input speed. Such a system can have an average shuttle velocity that is in excess of 80% of the peak shuttle velocity as shown by curve 144 of FIG. 3. A motor that allows such a cyclically changing rotary input speed is described in more detail below.

Figure 4:
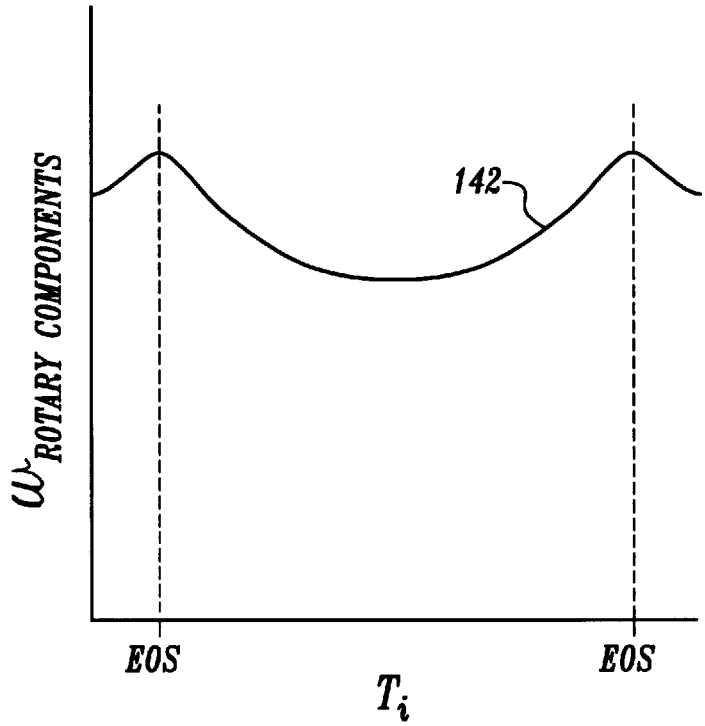
FIG. 4 is an angular velocity diagram of the rotational components of a low rotational inertia carriage shuttle system formed in accordance with the present invention.

The rotational components (the first, second, and third crank arms 80, 82, and 84) of the printer 20 have a rotary velocity profile that is illustrated by the curve 142 in FIG. 4. As seen in FIG. 4, the rotary velocity, i.e., the angular velocity, of the rotational components is greater at the ends of a shuttle stroke, and less during the middle of the shuttle stroke. When the translating components (the carriage 22, the connecting rods 70 and 74, and the counterbalance 62) stop moving, the kinetic energy of the translating components is absorbed by the rotational components. Preferably, the minimum kinetic energy of the rotational components is less than or equal to the maximum kinetic energy of the translational components and are denoted by equations (1) and (2).

$$KE_R = \tfrac{1}{2} I_R \theta^2; \tag{1}$$

where $I_R$ equals the rotational inertia of the rotating components.

$$KE_T = \tfrac{1}{2} m\dot{x}^2; \tag{2}$$

where m equals the mass of the translating components.

Still referring to FIG. 4, at the end of stroke (EOS), the angular velocity of the rotational components peaks. At the midpoint, the angular velocity drops to a minimum value as shown by the trough of curve 142. As the rotational components slow, the kinetic energy of the rotational components is absorbed by the translating components. As a result, the translating components increase speed. The variation in the angular velocity of the rotational components tends to flatten the output velocity profile of the carriage 22, transforming it from a sinusoidal waveform to more of a square-shaped waveform, as shown by the second waveform 144 in FIG. 3, where the maximum translation velocity of the carriage, denoted as $\dot{x}$, is at the midstroke. The motor 64 adds only enough energy to overcome frictional losses and to linearize the velocity profile, as described in greater detail below. Because the minimum kinetic energy of the rotational components is lower than the peak kinetic energy of the translating components, the conservation of kinetic energy has a much more noticeable effect on the input velocity than does a system that incorporates a large flywheel.

The low rotational inertia of the rotational components can be modeled by mathematical equations by assuming that the printer system operates at a substantially constant level of kinetic energy for the predetermined velocity profile illustrated in FIG. 3. Thus, the kinetic energy, $KE_R$, is set approximately equal to or less than the translational energy, $KE_T$, (i.e., $KE_R \leqq KE_T$). Borrowing the definitions of $KE_R$ and $KE_T$ from equations (1) and (2), the constant level of kinetic energy reduces to equation (3):

$$\frac{1}{2} I_R \dot{\theta}^2 \leqq \frac{1}{2} m\dot{x}^2; \tag{3}$$

If $$x = -e \cos\theta \text{ where } e = \tfrac{1}{2}(\text{reciprocating amplitude}) \text{ or } e = \tfrac{1}{2}E \tag{4}$$

then $$\dot{x} = \frac{dx}{dt} = e\dot{\theta}\sin\theta; \tag{5}$$

As illustrated in FIG. 3, $\dot{x}$ achieves it's maximum value at $\theta = 90°$. Accordingly, evaluating equation (5) at a value of $\theta = 90°$ results in;

$$\dot{x} = \theta; \tag{6}$$

Substituting now equation (6) for $\dot{x}$; equation (3) reduces to equation (7):

$$\frac{1}{2} I_R \dot{\theta}^2 \leqq \frac{1}{2} m e^2 \dot{\theta}^2 \tag{7}$$

Simplifying now and substituting e=½E, equation (7) results in equation (8);

$$I_R \leqq \frac{m(E^2)}{4}. \tag{8}$$

Thus, the low rotational inertia of the rotational components ($I_R$) of the shuttle system having a substantially similar velocity profile, as shown by the second waveform 144 in FIG. 3, is dependent on the mass of the translating components times the distance of carriage travel, squared, divided by four. Hence, for any given shuttle system having a predetermined translational mass (m) and translating distance (E) that desires to have the velocity profile of waveform 144 illustrated in FIG. 3, one can calculate the desired rotational inertia of the rotational components of the given shuttle system from equation (8). Accordingly, one can then design the rotational components of the given shuttle system so that the rotational inertia of the rotational components is less than or equal to the quantity determined in equation (8) (i.e., $m(E^2)/4$).

There are several motors currently available and well known in the art that can be used in actual embodiments of the invention. As noted above, the chosen motor must not be one designed to produce a constant rotational velocity, such as an AC motor. Motors suitable for use by the invention include direct current ("DC") and stepper motors. An open loop DC motor allows the angular velocity of the rotational components to vary in a fashion similar to curve 142 illustrated in FIG. 4 and described above.

While a series wound DC motor is usable in embodiments of the invention, a stepper motor may be more is more desirable because, in addition to allowing the low rotational inertia shuttle system to operate at a substantially constant level of kinetic energy, the stepper motor can be controlled to optimize the constancy of the carriage velocity profile. Because each individual step of a stepper motor can be controlled by reading a control signal, stored in a table of data points in the memory of a microcontroller 148 (FIG. 2), the motor can be made to speed up and slow down in a very precise manner within a shuttle cycle. In essence, a stepper motor allows energy to be added to or subtracted from the low rotational inertia shuttle system in a very precise manner. Thus, the speed of a stepper motor can be tuned to maintain a constant or near constant carriage speed over most of the print stroke. At the ends of the shuttle stroke, the kinetic energy transfer from the translating components to the rotating components assists the motor in accomplishing a very rapid turnaround of the carriage 22. Angular accelerations far greater than the motor could accomplish with a constant, high rotational inertia load, or even with no load, are achievable. In such a system, the output of the position sensor is utilized to synchronize the motor drive pulses produced by the microcontroller 148 with the actual position of the carriage 22.

As noted above, the microcontroller 148 may read the time duration of each step of the stepper motor from a table stored in memory. As a non-limiting example, the microcontroller can be programmed to step the carriage 22 across the shuttle range according to a predetermined number of steps, each lasting a finite time period as dictated by the stored table. When the carriage 22 reaches the end of stroke position, the position sensor 146 sends a sensed signal to the microcontroller indicating that the carriage 22 has reached the end of the print stroke. At the end of the print stroke, the microcontroller synchronizes the beginning of the table with the end of stroke. The programmed steps are such that the stepper motor either adds or subtracts energy in the mid-stroke region of the print range in a way that maximizes the linearity of the carriage velocity profile. In essence, the data stored in the table matches a predetermined, linearized velocity profile.

Figure 5:
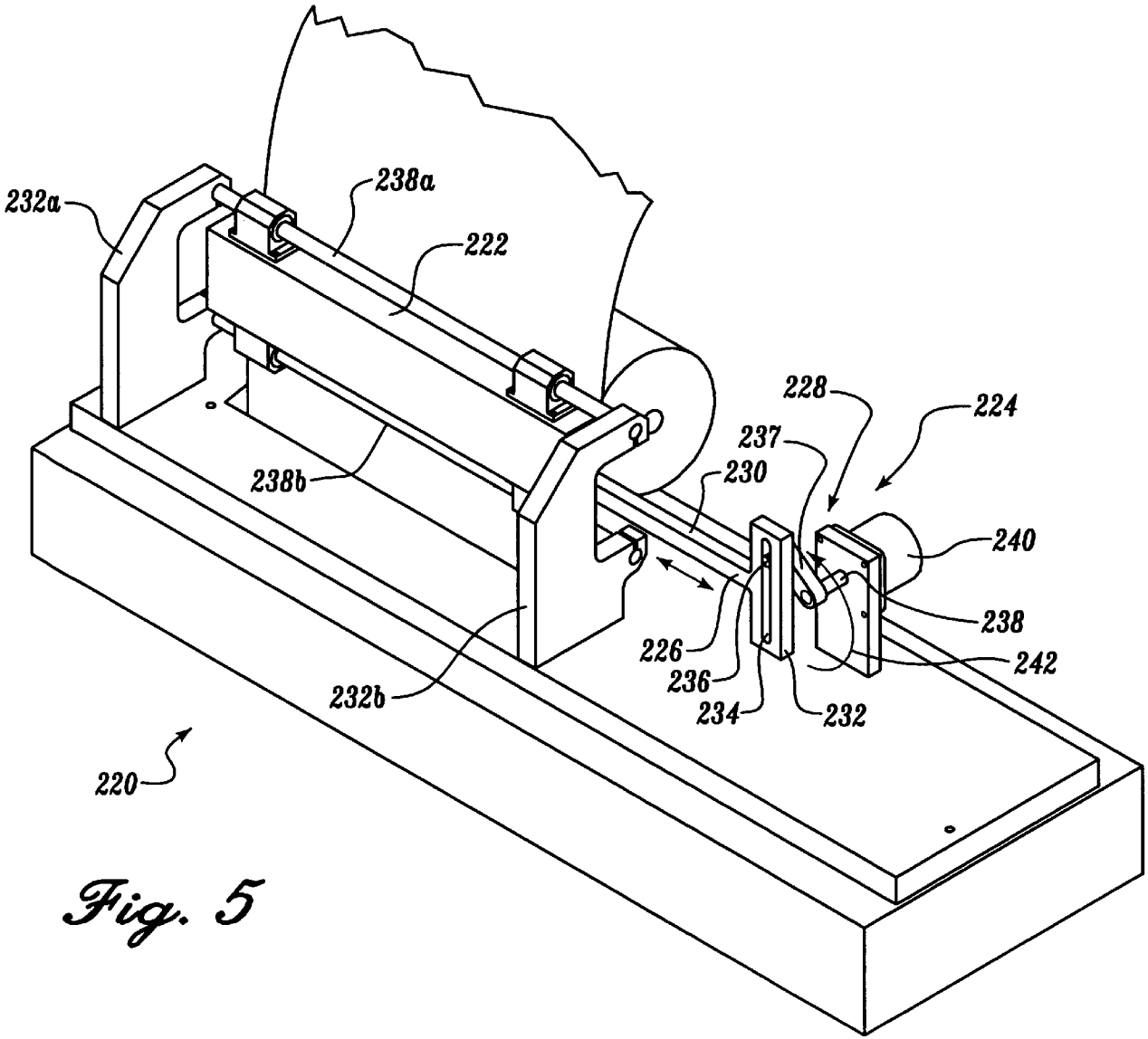
FIG. 5 is a perspective view of a dot matrix line printer incorporating a low rotational inertia carriage shuttle system formed in accordance with an alternate embodiment of the present invention as a Scotch yoke mechanism.

FIG. 5 is an alternate embodiment of a dot matrix printer 220 formed in accordance with the preferred embodiment of the invention as described above, except that the carriage drive assembly is in the form of a Scotch yoke mechanism 224. As described above, the carriage 222 may be supported by first and second carriage guide rods 238*a* and 238*b* mounted between first and second carriage support members 232*a* and 232*b*. The carriage 222 is reciprocated between the first and second carriage support members 232*a* and 232*b* by the Scotch yoke mechanism 224. The Scotch yoke mechanism 224 includes a T-shaped Scotch yoke 226 and a crank assembly 228. The Scotch yoke 226 includes a connecting member or spine 230 and head 232 transversely attached to one end of the spine 230. The other end of the spine 230 is attached to the carriage 222 and causes the carriage 222 to reciprocate between the first and second carriage support members 232*a* and 232*b* as the Scotch yoke is driven in the manner described below.

The head 232 of the Scotch yoke 226 includes a slot 234 that lies normal to the longitudinal axis of the spine 230. The slot 234 is sized to receive a slider pin 236 that forms part of the crank assembly 228. In addition to the slider pin 236, the crank assembly 228 includes a rotational member or arm 237. The slider pin 236 projects outwardly from one end of the arm 237. The other end of the arm 237 is attached to the shaft 238 of a motor 240. Power supplied to the motor by an external power source (not shown) causes the arm 237 to rotate in one direction indicated by the arrow 242. As the arm 237 rotates, the slider pin 236 traverses the slot 234 of the Scotch yoke 226, causing the carriage 222 to reciprocate between the first and second carriage support members 232*a* and 232*b*.

As with the embodiment of the invention shown in FIG. 1 and described above, speed of the drive motor changes as the carriage reciprocates in a manner that produces a near constant velocity profile. As with the embodiment of the invention shown in FIG. 1, the motor 240 can be a DC motor or a controlled stepper motor. Further, as discussed above with respect to the embodiment shown in FIG. 1, the low rotational inertia of the rotational components (i.e., the rotational components of the Scotch yoke 226) is less than or equal to $M(E)^2/4$.

Figure 6:
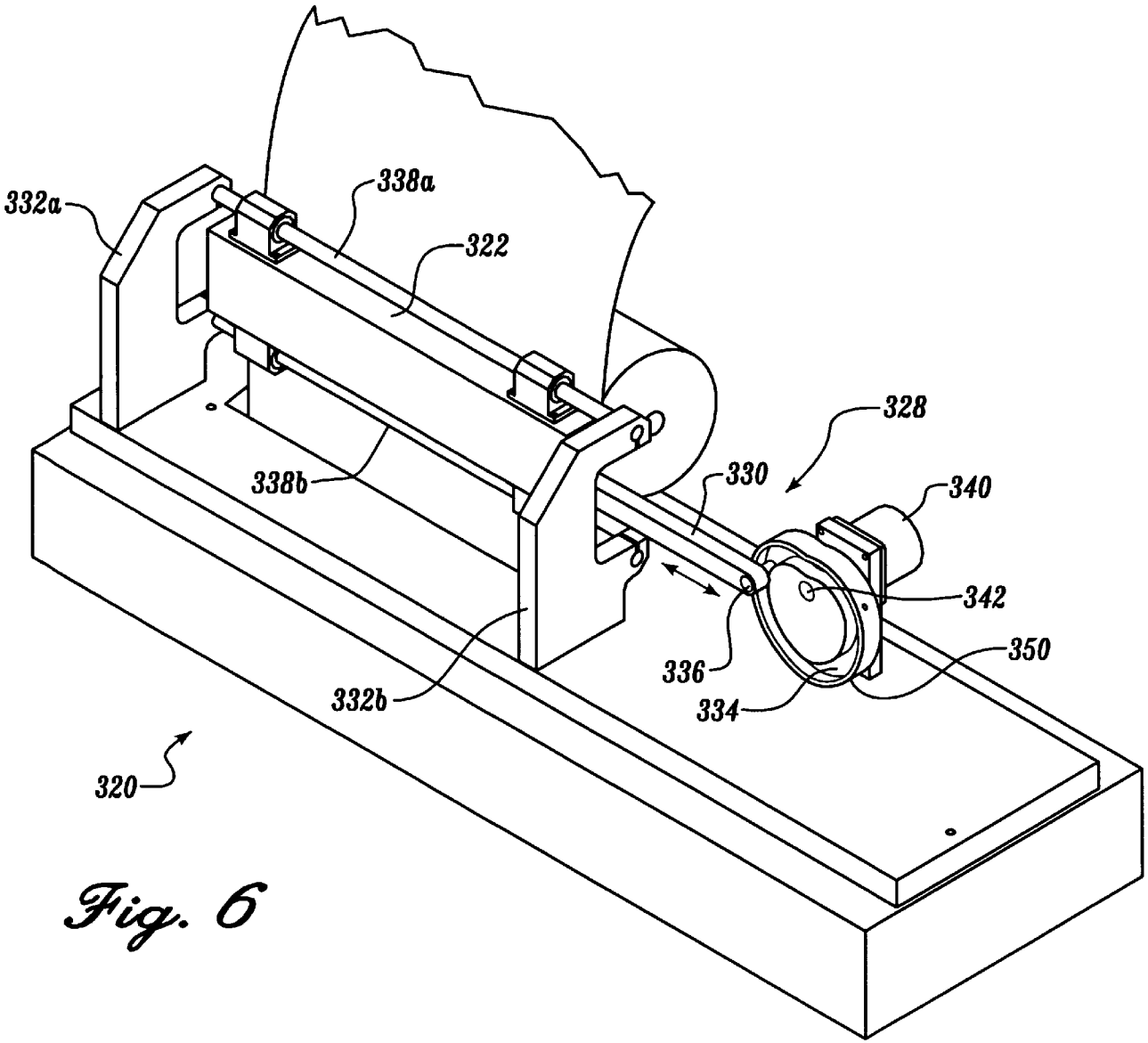
FIG. 6 is a perspective view of a dot matrix line printer incorporating a low rotational inertia carriage shuttle system formed in accordance with an alternate embodiment of the present invention as a cam driven mechanism.

A second alternate embodiment of the carriage drive assembly is illustrated in FIG. 6. The carriage 322 of the dot matrix printer 320 of the alternate embodiment shown in FIG. 6 is constructed and operated in the same manner as the other embodiments of the invention. More specifically, the carriage 322 is reciprocally mounted on first and second carriage guide rods 338*a* and 338*b*, extending between first and second carriage support members 332*a* and 332*b*. The carriage 322 is reciprocated between the first and second carriage support members 332*a* and 332*b* by a cam drive assembly 328.

The cam drive assembly 328 includes a connecting member or attachment arm 330, a rotational member or sinusoidal or harmonic cam 350, and a cam follower 336. One end (not shown) of the attachment arm 330 is attached to the carriage 322. The cam follower 336 projects normally outwardly from the other end of the attachment arm 330 and engages the cam track 334 of the cam 350. The cam 350 is mounted on the shaft 342 of a motor 340. The cam track 334 has a predetermined sinusoidal path that causes the carriage 322 to reciprocate between the first and second carriage support members 332*a* and 332*b* as the cam 350 is rotated by the motor. As described above with respect to the other embodiments of the invention, the motor may be a DC motor or a stepper motor. The motor speeds up or slows down as necessary to create a near constant shuttle velocity profile. Further, as discussed above with respect to the other embodiment of the invention, the low rotational inertia of the rotational components (i.e., the cam 250) is less than or equal to $M(E)^2/4$.

The previously described version of the present invention provides several advantages over line printers currently available in the art. The purposeful minimization of the rotational mass with respect to the mass of the translating components produces a carriage velocity profile that is substantially linear throughout the print range of shuttle motion thereby increasing throughput. Because it operates at a substantially constant level of kinetic energy, a low rotational inertia shuttle system formed in accordance with the present invention requires less power input than do other methods of producing flattened sinusoidal carriage velocities. This allows the actual embodiment of the invention to use a small, inexpensive motor and drive electronics.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A low rotational inertia shuttle system having a stationary state, a non-stationary state, and a support structure, comprising:

(a) a first reciprocating mass (M) having a predetermined amount of translational kinetic energy in said non-stationary state, said reciprocating mass movably mounted on said support structure;

(b) a reciprocating mechanism having a predetermined amount of rotational kinetic energy in said non-stationary state, said reciprocating mechanism coupled to said reciprocating mass to reciprocate said reciprocating mass along a linear path of travel having a first end, a second end, and a center, wherein said reciprocating mechanism has a rotational inertia such that the translational kinetic energy of said reciprocating mass is larger than or equal to the rotational kinetic energy of said reciprocating mechanism at the center of the path of travel of the reciprocating mass when said reciprocating mass is reciprocated by said reciprocating mechanism in said non-stationary state between said first and second ends; and (c) a rotary motor for driving said reciprocating mechanism.

2. The low rotational inertia shuttle system of claim 1, wherein said motor comprises a DC motor.

3. The low rotational inertia shuttle system of claim 1, wherein said motor comprises a stepper motor and a control system that selectively varies the output of said stepper motor so that said reciprocating mass moves at a relatively constant speed over a predetermined amount of the reciprocating mass' path of travel.

4. The low rotational inertia shuttle system of claim 3, wherein said reciprocating mechanism comprises a linkage assembly.

5. The low rotational inertia shuttle system of claim 4, wherein said reciprocating mechanism comprises double throw cranks and horizontally opposed connecting arms.

6. The low rotational inertia shuttle system of claim 5, further comprising a second reciprocating mass coupled to said reciprocating mechanism mounted on said support structure.

7. The low rotational inertia shuttle system of claim 6, wherein said second reciprocating mass is a counterbalance.

8. The low rotational inertia shuttle system of claim 3, wherein the control system selectively varies the output of said stepper motor during continues operation of the shuttle system.

9. The low rotational inertia shuttle system of claim 3, wherein said stepper motor is controlled to selectively vary the stepper motor output based on data obtained by the control system.

10. The low rotational inertia shuttle system of claim 1, wherein said reciprocating mass (M) has a predetermined reciprocating amplitude (E), and wherein said reciprocating mechanism having a rotational inertia that is less than or equal to $(M(E)^2)/4$.

11. The low rotational inertia shuttle system of claim 1, wherein said reciprocating mechanism comprises a Scotch yoke mechanism.

12. The low rotational inertia shuttle system of claim 1, wherein said reciprocating mechanism comprises a cam drive system.

13. In a dot matrix line printer having a stationary state and a non-stationary state, the printer including a carriage having a predetermined amount of translational kinetic energy in the non-stationary state and a predetermined reciprocating mass (M), said carriage movably mounted on a support structure for back and forth movement, the improvement comprising a shuttle system for moving said carriage back and forth, said shuttle system comprising:

(a) a counterbalance reciprocally mounted on said support structure;

(b) a linkage assembly having a predetermined amount of rotational kinetic energy in the non-stationary state, said linkage assembly disposed between said carriage and said counterbalance for reciprocating said carriage and said counterbalance along a linear path of travel of amplitude (E) having a first end, a second end, and a center, said linkage assembly having a rotational inertia such that the translational kinetic energy of said carriage is larger than or equal to the rotational kinetic energy of said linkage assembly at the center of the path of travel of the carriage when said carriage is reciprocated by said linkage assembly in said non-stationary state between said first and second ends; and (c) a motor coupled to said linkage assembly for rotationally driving said linkage assembly.

14. The improvement claimed in claim 13, wherein said motor comprises a DC motor.

15. The improvement claimed in claim 13, wherein said motor comprises a stepper motor and wherein said stepper motor also includes a control system for selectively varying the output of said stepper motor so as to move said carriage at a relatively constant speed over a predetermined amount of the carriage's path of travel.

16. The improvement claimed in claim 13, wherein said rotational inertia of said linkage assembly is less than or equal to $(M(E)^2)/4$.

17. The improvement claimed in claim 13, wherein said motor is configured to permit a cyclically changing rotary input speed to be imparted on said linkage assembly.

18. A method of linearizing the velocity profile of a carriage, comprising:

(a) reciprocally mounting a carriage on a support structure, said carriage having a predetermined amount of translational kinetic energy and a predetermined mass (M);

(b) reciprocally mounting a counterbalance on said support structure;

(c) connecting a linkage mechanism to said carriage and said counterbalance such that said carriage and said counterbalance reciprocate together along a path of linear travel (E) having a first end, a second end, and a center, said linkage mechanism having a rotational inertia and a predetermined amount of rotational kinetic energy;

(d) minimizing the rotational inertia of said linkage mechanism such that the translational kinetic energy of said carriage is larger than or equal to the rotational kinetic energy of said linkage mechanism at the center of the path of travel of the carriage; and (e) supplying energy to said linkage mechanism by a motor.

19. The method of claim 18, further comprising minimizing the rotational inertia of said linkage system such that said rotational inertia is less than or equal to $(M(E)^2)/4$.

20. The method of claim 18, wherein said motor comprises a DC motor.

21. The method of claim 20, wherein said motor comprises a stepper motor.

22. The method of claim 21, wherein said stepper motor is controlled to reciprocate said carriage at a relatively constant speed over a predetermined amount of the carriage's path of travel.

23. A low rotational inertia shuttle system having a support structure, comprising:

(a) a first reciprocating mass having a predetermined reciprocating amplitude (E), said reciprocating mass movably mounted on said support structure;

(b) a reciprocating mechanism including at least one connecting member connected to said first reciprocating mass, said at least one connecting member and said first reciprocating mass having a total predetermined mass (M), said reciprocating mechanism also includes at least one rotational member connected to said connecting member, said reciprocating mechanism reciprocates said reciprocating mass along said predetermined reciprocating amplitude (E), said at least one rotational member having a rotational inertia that is less than or equal to $(M(E)^2)/4$; and (c) a rotary motor connected to said rotational member for driving said reciprocating mechanism.

24. The shuttle system of claim 23, wherein said rotary motor is configured to permit a cyclically changing rotary input to be imparted to said reciprocating mechanism.

25. The shuttle system of claim 23, wherein said connecting member is a connecting rod and said rotational member is a crank arm.

26. The shuttle system of claim 23, wherein said connecting member is a spine and said rotational member is a crank arm, said crank arm includes a slider pin, said crank arm connected to said spine through said slider pin.

27. The shuttle system of claim 23, wherein said connecting member is an attachment arm and said rotational member is a cam, said attachment arm includes a cam follower, said cam connected to said attachment arm through said cam follower.

28. A method of increasing the throughput of a printer, said printer having a reciprocating carriage of mass (M), a reciprocating mechanism connected to said carriage for reciprocating said carriage along a path of travel of amplitude (E), and a motor drivingly connected to said reciprocating mechanism, the method comprising:

selecting the size and configuration of said reciprocating mechanism such that the translational kinetic energy of said carriage is larger than or equal to the rotational kinetic energy of said reciprocating mechanism along a portion of said path of travel of said carriage;

controlling the operation of said motor by selectively varying the output of said motor so that said carriage moves at a relatively constant speed over a predetermined amount of said carriage's path of travel.

29. A method of making a printer having a linearized velocity profile, said printer having a support structure, the method comprising:

selecting a carriage having a mass (M);

selecting a reciprocating amplitude (E) for said carriage;

reciprocatingly mounting said carriage on said support structure;

configuring a reciprocating mechanism based on said reciprocating amplitude (E) and carriage mass (M) so that said carriage may be reciprocated between two end positions of reciprocating amplitude (E), and so that said reciprocating mechanism's rotational inertia is such that the translational kinetic energy of said carriage is larger than or equal to the rotational kinetic energy of said reciprocating mechanism along a portion of the path of travel of said carriage during operation of the printer; and connecting said reciprocating mechanism to said carriage such that said carriage may reciprocate along the path of travel having reciprocating amplitude (E).

* * * * *